US007559828B2

(12) United States Patent
Liao

(10) Patent No.: US 7,559,828 B2
(45) Date of Patent: Jul. 14, 2009

(54) DOUBLE-GRINDING-WHEEL TYPE DRILL BIT GRINDING DEVICE WITH A SINGLE DRIVING SHAFT AND GRINDING METHOD THEREOF

(75) Inventor: Ming-Ko Liao, Ta-Li (TW)

(73) Assignee: Taiwan More-Cash Villager Corp., Taichung (TW)

( * ) Notice: Subject to any disclaimer, the term of this patent is extended or adjusted under 35 U.S.C. 154(b) by 0 days.

(21) Appl. No.: 11/798,948

(22) Filed: May 18, 2007

(65) Prior Publication Data

US 2007/0243801 A1 Oct. 18, 2007

Related U.S. Application Data

(63) Continuation-in-part of application No. 11/405,413, filed on Apr. 18, 2006, now abandoned.

(51) Int. Cl.
*B24B 7/00* (2006.01)

(52) U.S. Cl. ..... 451/178; 451/179; 451/193; 451/231; 451/234; 451/375; 451/387; 451/215

(58) Field of Classification Search ..... 451/48, 451/178, 179, 182, 193, 231, 234, 212, 213, 451/214, 215, 358, 375, 376, 387, 405
See application file for complete search history.

(56) References Cited

U.S. PATENT DOCUMENTS 5,012,617 A * 5/1991 Winstanley ..... 451/65
6,517,411 B2 * 2/2003 Mortell et al. ..... 451/5
2003/0220057 A1 * 11/2003 Lin ..... 451/210

* cited by examiner

*Primary Examiner*—Eileen P. Morgan
(74) *Attorney, Agent, or Firm*—Rosenberg, Klein & Lee

(57) ABSTRACT

A double-grinding-wheel type drill bit grinding device with a single driving shaft comprising a power source disposed on a base, two grinding wheels being disposed at opposite ends of the single driving shaft extending out of the power source. The grinding device further comprises two pair of first grinding and second grinding seats, each pair of first and second grinding seats being disposed close to the respective grinding wheels at both ends of the driving shaft, a clamping assembly for clamping a drill bit to support the drill bit upon sequential insertion into one pair of the first and second grinding seats, and a positioning device being disposed on a front surface of the base for providing alignment of the drill bit within the clamping assembly prior to the insertion of the drill bit into one pair of the first and second grinding seats. The power source is a pneumatic motor and is provided with a vacuum passage for facilitating dust discharge.

16 Claims, 14 Drawing Sheets

DOUBLE-GRINDING-WHEEL TYPE DRILL BIT GRINDING DEVICE WITH A SINGLE DRIVING SHAFT AND GRINDING METHOD THEREOF

CROSS-REFERENCES TO RELATED APPLICATIONS

The present invention is a continuation-in-part application of the U.S. application Ser. No. 11/405,413, filed on Apr. 18, 2006 now abandoned.

BACKGROUND OF THE INVENTION

1. Field of the Invention

The present invention relates to a double-grinding-wheel type drill bit grinding device with a single driving shaft and grinding method thereof, and more particularly to a grinding device with a grinding wheel at each end of the driving shaft of the motive power source. The grinding device also has multiple positioning devices. Each grinding wheel has at least two grinding seats adjacent thereto. With the two grinding wheels, the positioning devices, and two grinding seats corresponding to each grinding wheel, the grinding device is capable of grinding two right spin drill bits and two left spin drill bits simultaneously.

2. Description of the Prior Art

U.S. Pat. No. 38,119 discloses a drill bit structure, and U.S. Pat. No. 6,517,411 discloses a grinding device designed for grinding the drill bit structure of U.S. Pat. No. 38,119, and the drill bit grinding device is provided with two grinding wheels at both sides of the table thereof. This type of drill bit grinding device is a large-scale machine, and the two grinding wheels are driven by two different motive power sources, it is not only difficult to carry but also wastes electric energy. Further, its adjustable range of the grinding angle is too limited since only the flat grinding surface of the grinding wheels cooperate with the base for fixing the drill bit, and it is unable to grind the right spin drill bit and the left spin drill bit simultaneously, and the grinding operation must depend on the individual grinding skills, otherwise, it will cause grinding errors.

U.S. Pat. No. 6,652,367 discloses another drill bit grinding device which employs a single driving shaft to drive a single grinding wheel, and this type single driving shaft grinding device is also unable to grind the right spin drill bit and the left spin drill bit simultaneously.

The present invention has arisen to mitigate and/or obviate the afore-described disadvantages.

SUMMARY OF THE INVENTION

The primary objective of the present invention is to provide a double-grinding-wheel type drill bit grinding device with a single driving shaft and grinding method thereof, it comprises a motive power source disposed on a base, two grinding wheels being disposed at both ends of the driving shaft extending out of the motive power source. The grinding device further comprises a first grinding seat with multi-axis deflectable positions for grinding cutting edges on a drill bit, and a second grinding seat with an apex and adjustable apex depth, wherein each grinding wheel has the first grinding seat and second grinding seat disposed adjacent thereto so that the grinding device is capable of grinding right spin drill bit or left spin drill bit.

The second objective of the present invention is to provide a double-grinding-wheel type drill bit grinding device with a single driving shaft and grinding method thereof, wherein the motive power source is a motor and is provided with a vacuum passage for facilitating dust discharge, and therefore, it is environmental friendly.

BRIEF DESCRIPTION OF THE DRAWINGS

FIG. 7-1 is a side view showing the grinding wheel in accordance with the present invention;

FIG. 7-2 is an explanatory view showing the first grinding seat and the grinding wheel of FIG. 7-1 in grinding a drill bit;

FIG. 7-3 is an explanatory view showing the position relationship of the first grinding seat and the grinding wheel of FIGS. 7-1 and 7-2;

FIG. 8-1 is an explanatory view showing an example of drill bit of the present invention;

FIG. 8-2 is a top view of one example of the drill bit of the present invention;

DETAILED DESCRIPTION OF THE PREFERRED EMBODIMENTS

The present invention will become clearer from the following description when taken in connection with the accompanying drawings, which show, for purpose of illustrations only, the preferred embodiment in accordance with the present invention.

Figure 1:
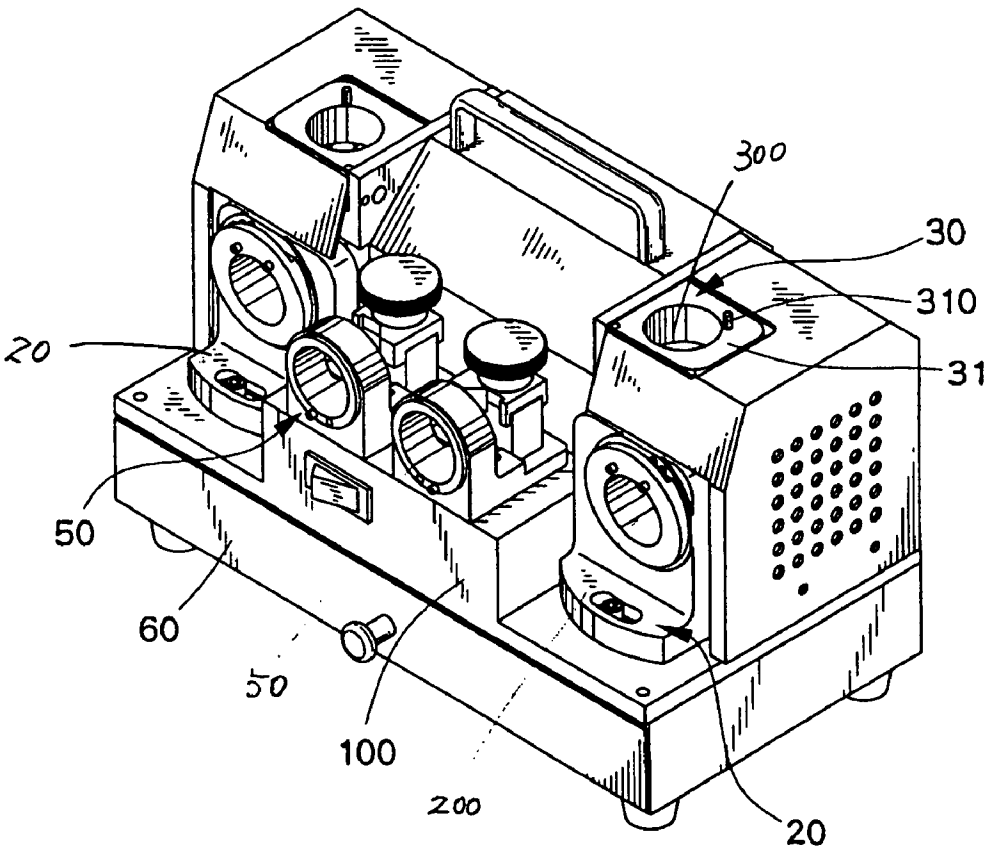
FIG. 1 is a perspective view of a double-grinding-wheel type drill bit grinding device with a single driving shaft in accordance with the present invention.
Figure 2:
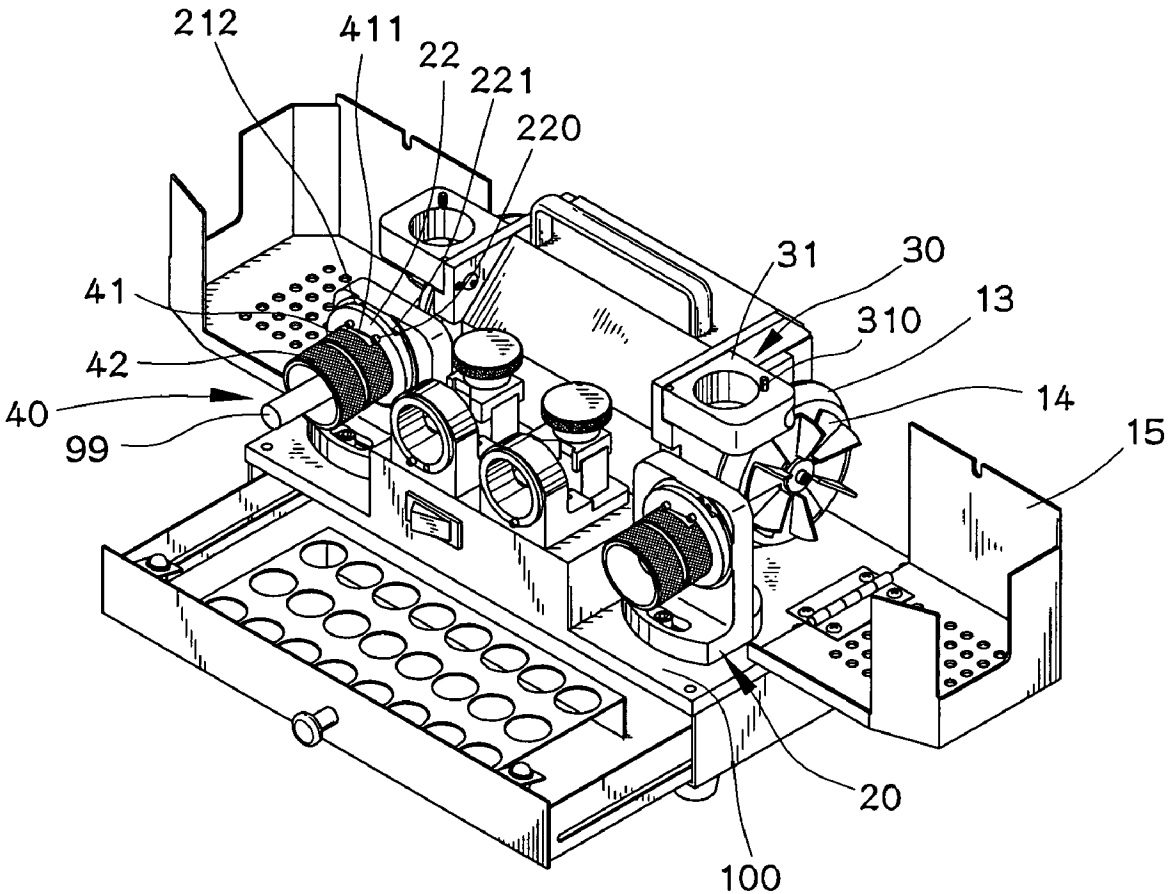
FIG. 2 shows the construction of the double-grinding-wheel type drill bit grinding device with a single driving shaft in accordance with the present invention after the two grinding wheel covers are opened, and the drawer is pulled out from the base.
Figure 3:
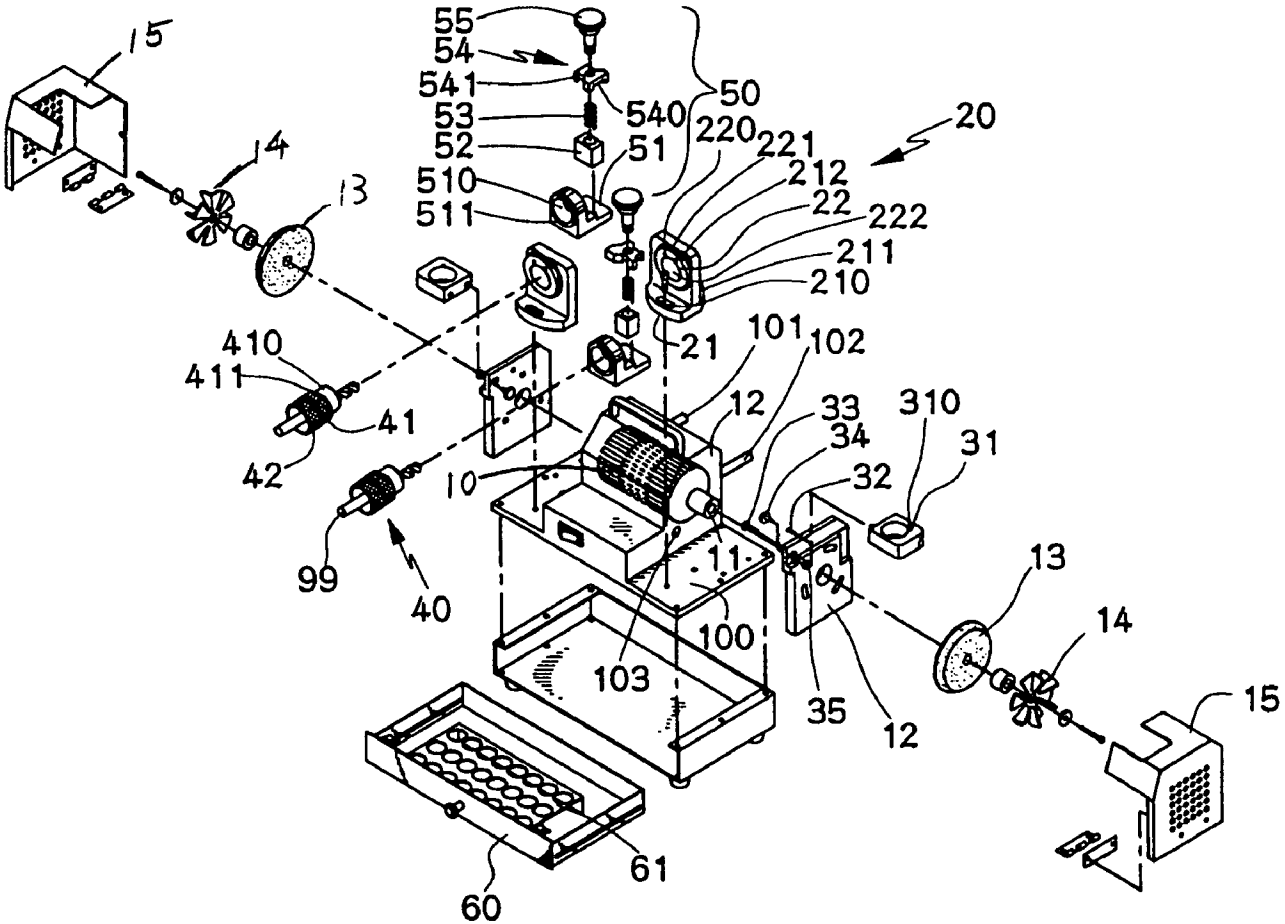
FIG. 3 is an exploded view of the double-grinding-wheel type drill bit grinding device with a single driving shaft in accordance with the present invention.

Referring to FIGS. 1-3, a double-grinding-wheel type drill bit grinding device with a single driving shaft in accordance with the present invention comprises a motive power source 10 disposed on a base 100. The motive power source 10 has a continuous driving shaft extending beyond opposing supporting members 12 on the base 100. Each end of the driving shaft is connected to a grinding wheel 13, respectively. A cooling fan 14 is attached to the outer side of the respective grinding wheels 13. At each side of the base 100 is additionally respectively disposed with a cover 15 for covering each grinding wheel 13.

A first grinding seat 20 and a second grinding seat 30 are installed respectively in front of and above each grinding wheel 13. A clamping assembly 40 for clamping a drill bit 99 is used to insert the drill bit 99 into the round socket formed on each of the first and second grinding seats 20, 30. On the upper surface of the base 100 and by the first grinding seat 20, there are more than one positioning device 50 for positioning the clamping assembly 40 and adjusting the relative position between the clamping assembly 40 and the drill bit 99 to be clamped inside the clamping assembly 40.

Each of the first grinding seats 20 includes a base member 21. An arc-shaped slide slot 210 is formed in the bottom plate of the base member 21 for allowing the first grinding seat 20 to be fixed onto the base 100 by insertion of a bolt. At the other end of the bottom plate of the base member 21, base member 21 is formed with a pivoting portion 211 to be fixed by a second bolt inserted in the base 100, so that the base member 21 is rotatable around the pivoting portion 211.

An eccentric rotating seat 22 is formed inside the vertical wall of the base member 21, and two positioning pins 220 are formed on the outer surface of the rotary seat 22. In operation, the clamping assembly 40 with drill bit 99 is mounted in and locked by the rotary seat 22, so that the clamping assembly 40 is rotatable together with the rotary seat 22. The rotary seat 22 is further provided with a flat and straight limit portion 221 located opposite to the vertical surface of the base member 21. And two opposite limit pins 212 are formed on the base member 21 for fixing the position of the rotating seat 22 and then to limit the deflection angle of the rotary seat 22 relative to the first grinding seat 20.

Figure 4:
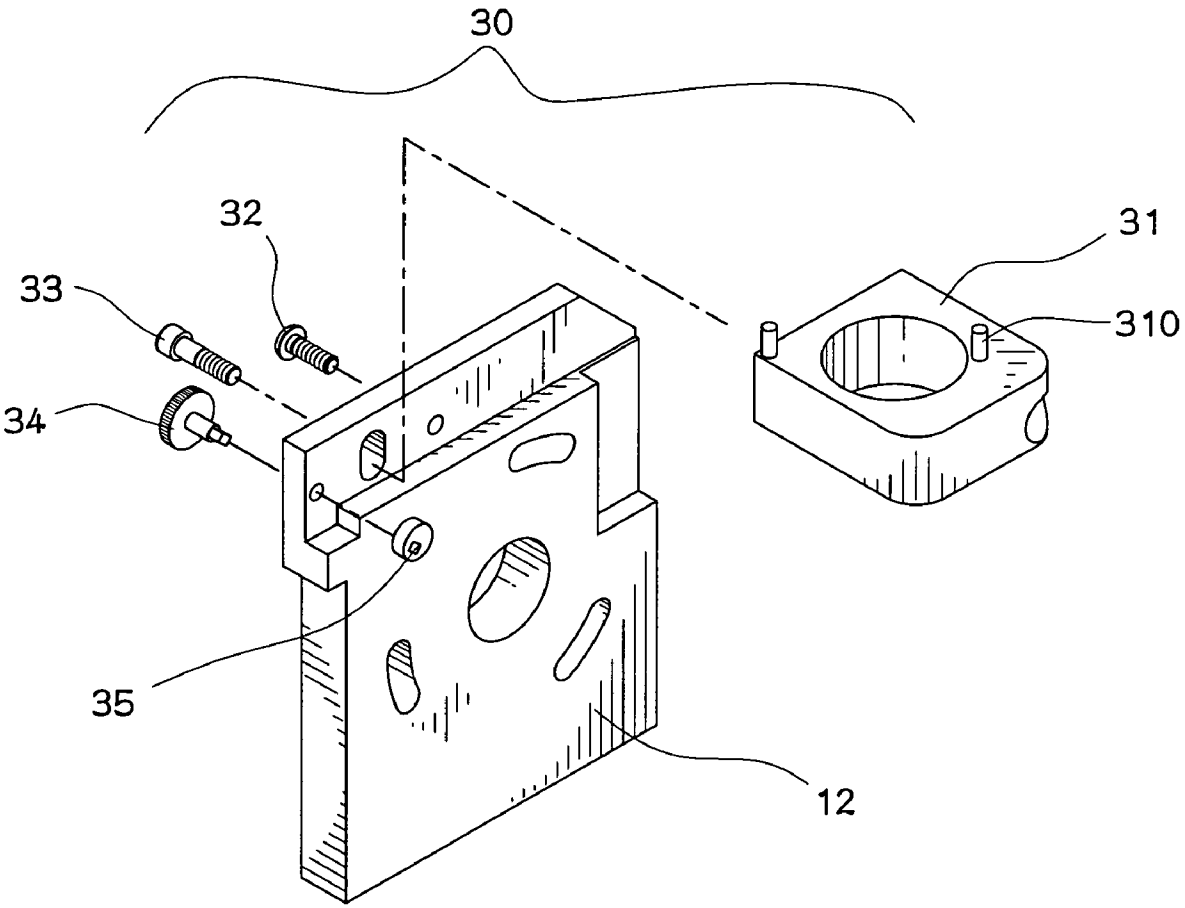
FIG. 4 is an exploded view showing the structure of the second grinding seat of the present invention.

As shown in FIGS. 1, 2, and 4, the second grinding seat 30 includes a base member 31 to be positioned on the supporting member 12. One portion of the base member 31 is pivotally connected to the supporting member 12 by a bolt 32, and another adjacent portion of the base member 31 is provided with a fixing bolt 33 to be bolted into the base member 31 via a hole formed in the supporting member 12. The base member 31 is positioned on the supporting member 12. As shown in FIG. 4, there is also a cam-controlling element 34 formed as a shaft to be inserted through the supporting member 12 into a cam-shaped abutting member 35. The abutting member 35 abuts against the bottom of the base member 31 so that the base member 31 can change its gradient to meet different cutting requirements of drill bit 99. The base member 31 is further provided with at least a limit pin 310 for limiting the deflection angle of the clamping assembly 40 relative to the base member 31.

Figure 11:
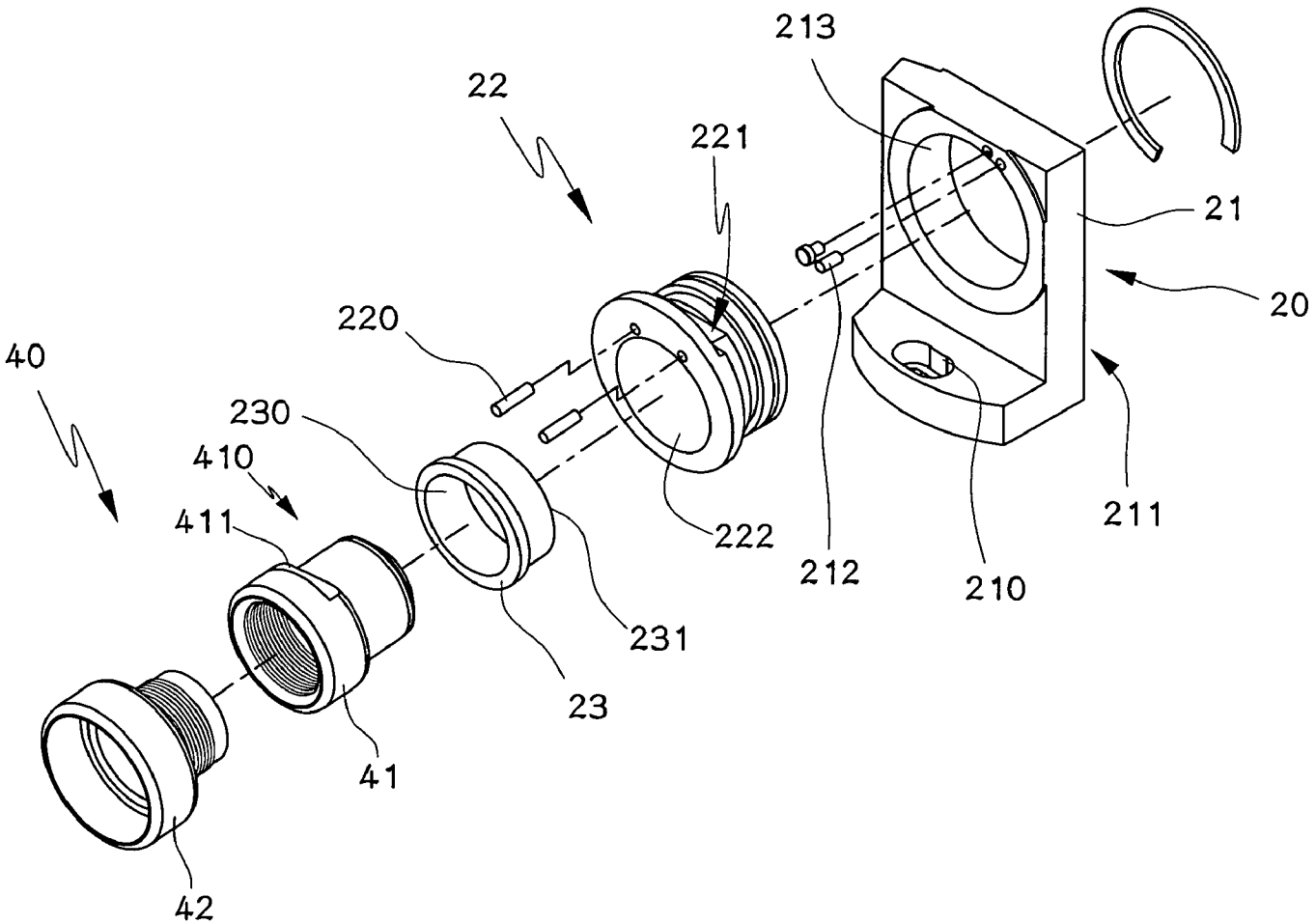
FIG. 11 is an exploded view showing the construction of the first grinding seat of the present invention.

As shown in FIGS. 2, 3 and 11, the clamping assembly 40 includes a clamping member 41 and a compressing member 42 screwed onto the clamping member 41. An elastic collet is disposed in the clamping member 41, and the end of the clamping member 41 is formed with a small-diameter receiving portion 410 for inserting into the grinding seat holes 200, 300 of the first and second grinding seats 20, 30. The large-diameter end of the receiving portion 410 is further defined with a flat and straight limit portion 411 so as to keep the clamping member 41 from moving by cooperating with the limit position 411 of the clamping member 41 with limit pins 220, 310 of the grinding seats 20, 30. The number of the positioning portions 411 is variable according to the number of the cutting edges of the drill bit 99.

Figure 5:
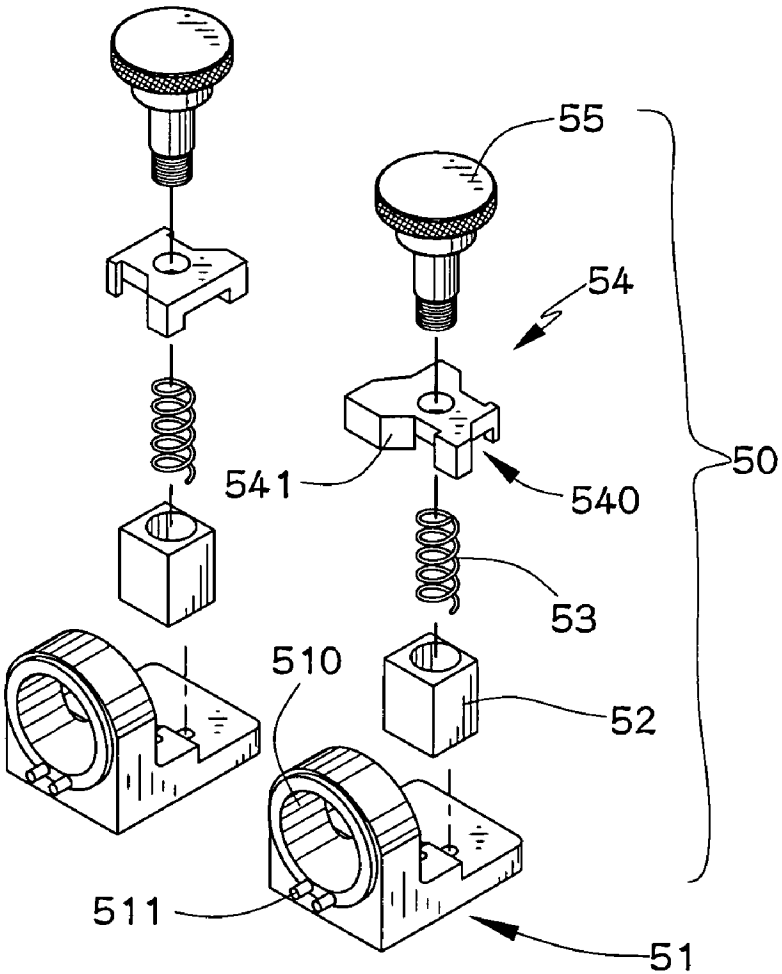
FIG. 5 is an exploded view showing the structure of the positioning devices of present invention.

As shown in FIG. 5, the positioning device 50 of the present invention includes a horizontally extended base member 51, a front end of the base member 51 is formed with a vertical extended wall having a receiving portion 510 in the form of a through hole, and a plurality of limit pins 511 is located around the outer periphery of the receiving portion 510 for cooperating with the limiting portions 411 of the clamping member 41 so as to provide alignment of the drill bit 99 clamped in clamping member 41 of clamping tool 40 when inserted in positioning device 50 as shown in FIG. 3. A column-shaped member 52 is disposed on the horizontal portion of the base member 51 and is formed as a hollow column having an inner space for accommodation of an elastic member 53 such as a helical spring. A drill positioning stop 54 is located on the top surface of member 52, and the bottom of the drill positioning stop 54 is formed as a concave 540 for cooperating with member 52. The central shaft of an adjusting knob 55 in the form of a threaded shaft is inserted through the center of the drill positioning stop 54. The threaded end of the central shaft of the adjusting knob 55 is threadedly engaged into the inner space of member 52, so that the drill positioning stop 54 is fixed to the top of member 52 by the adjusting knob 55. According to this embodiment, a drill positioning stop portion 541 with a shape corresponding to the shape of the cutting edge at the sharp end of the drill bit 99 is formed at a peripheral surface of the drill positioning stop 54. The present invention includes two positioning devices 50, and the drill positioning stop 54 of each positioning device 50 is preferably provided with four drill positioning stop portions 541, where each drill positioning stop portion 541 is a surface with a different gradient from the other drill positioning stop portions 541, so that the structure of the present invention is applicable to grinding at least eight kinds of drill bits 99 with different cutting edges.

Figure 6:
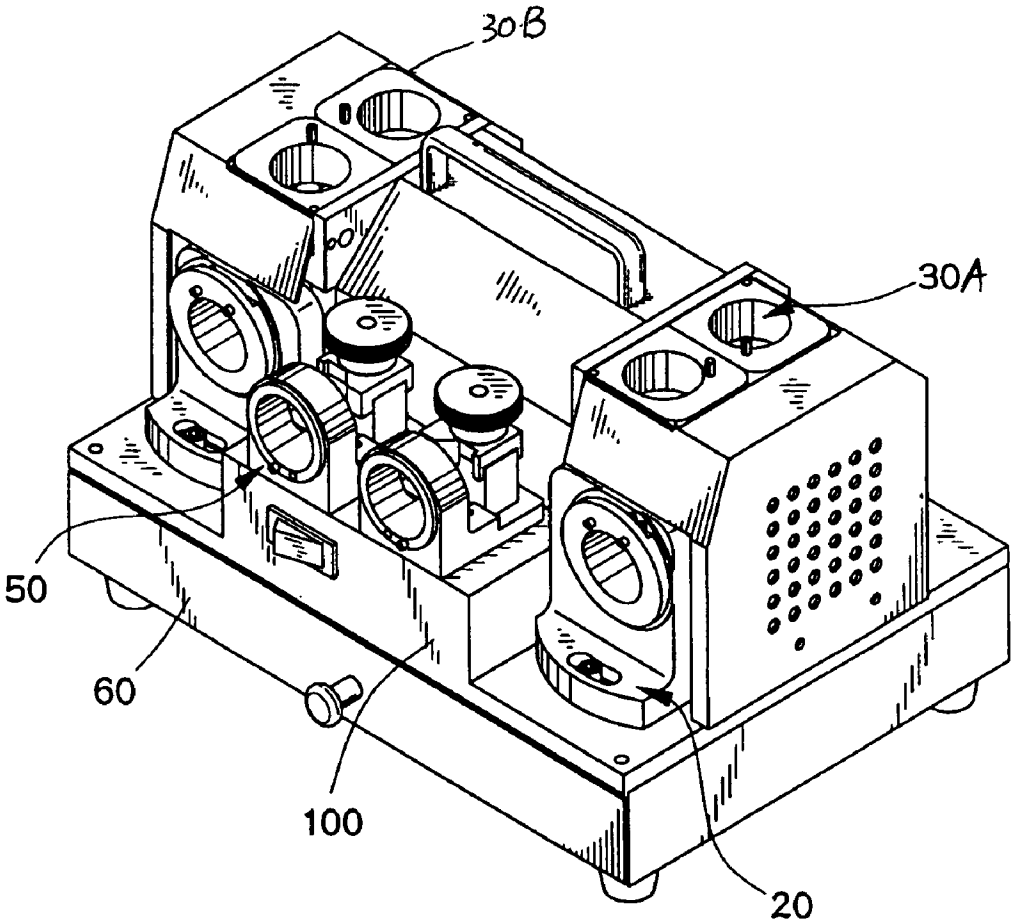
FIG. 6 is a perspective view showing another embodiment of the double-grinding-wheel type drill bit grinding device with a single driving shaft in accordance with the present invention.

In addition to each pair of first and second grinding seats 20, 30 at opposite sides of the motive power source 10, as shown in FIG. 6, another first and second grinding seats 20, 30 can be provided at each opposite side of the motive power source 10, so that the grinding device of the present invention is provided with four different grinding seats at each opposite side of the motive power source 10, thus providing a total of eight different grinding seats for meeting different grinding requirements.

Furthermore, as shown in FIGS. 2 and 3, a large storing member 60 formed as a drawer is disposed in an inner space at the bottom of the base 100. A holding frame 61 is disposed in the storing member 60 for holding different clamping assemblies 40 applicable for different drill bits 99.

The motive power source 10 of the present invention could be a general electric motor, or a pneumatic motor as shown in FIG. 3. An end of the pneumatic motor is an air-intake end 101, and the other end is an air-discharge end 102. A vacuum passage 103 is defined in the base 100 and positioned at the pneumatic motor, and the open ends of the vacuum passage 103 are disposed adjacent to the two grinding wheels 13. When the motive power source 10 operates, a negative pressure is created in the vacuum passage 103, so that grinding dust produced from the grinding wheels 13 is vacuumed into the vacuum passage 103 and then discharged out of the air-discharge end 102 of the motive power source 10 into a collector (not shown). The grinding dust is then prevented from being discharged into the atmosphere, which is environmental friendly.

Figures 1, 7:
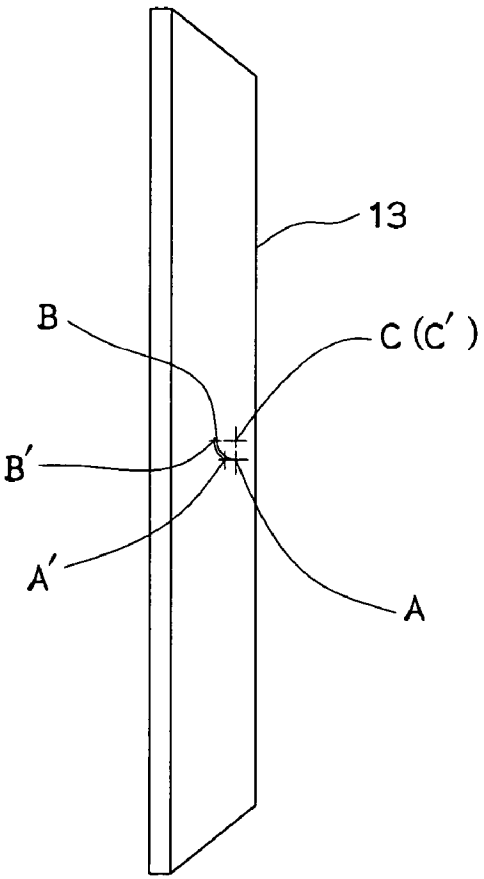
Figures 2, 7:
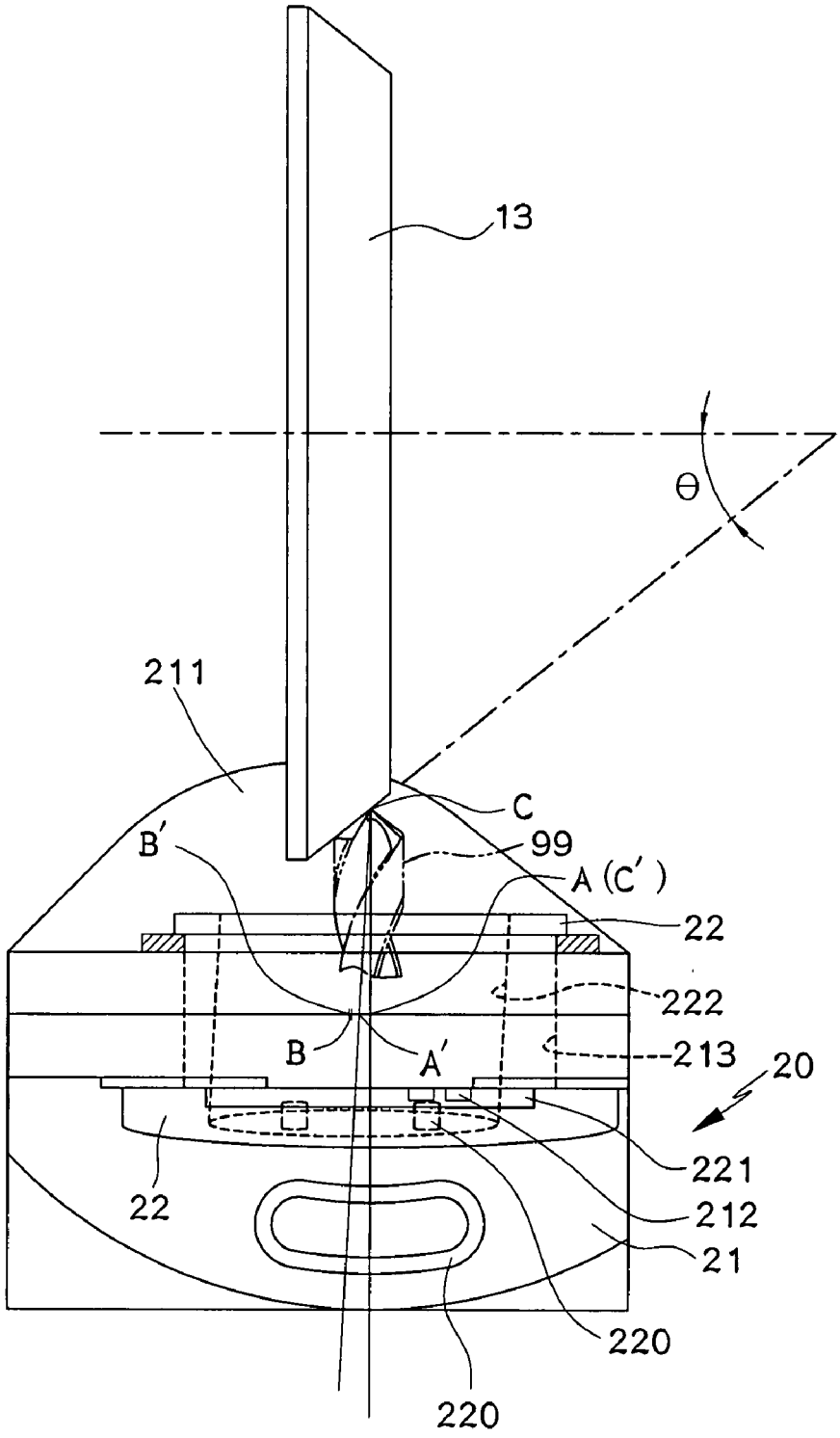
Figures 3, 7:
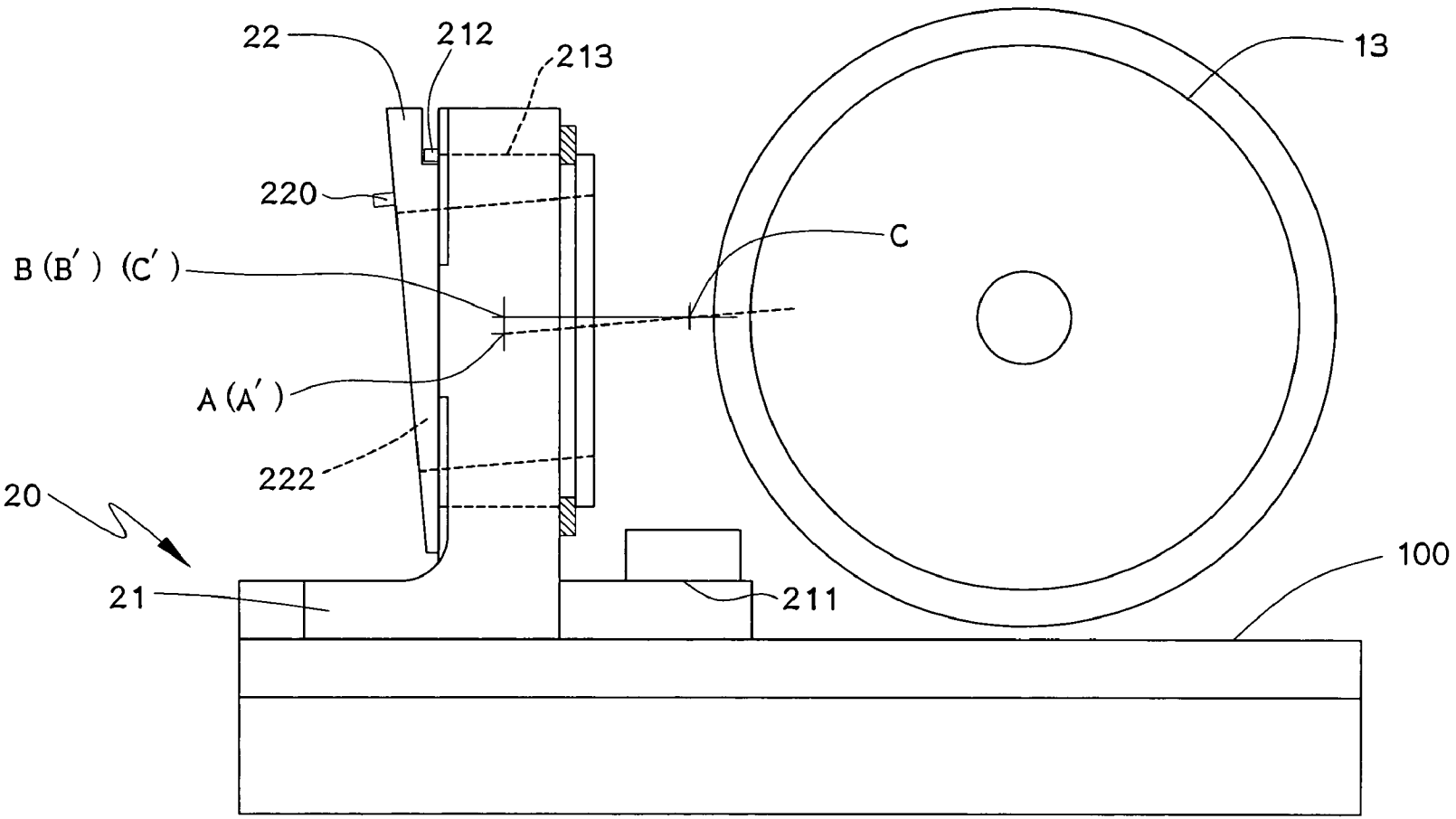

The structure of the rotating seat 22 of the base member 21 of the first grinding seat 20 is shown in FIGS. 7-1 to 7-3. An assembling portion 213 in the form of a round socket is formed in the vertical wall of the base member 21 for mounting the rotating seat 22, the rotating seat 22 is also formed with an assembling portion 222 in the form of a round socket for mounting the clamping assembly 40. A contact point at the intersection of the central axis of the drill bit 99 at the center of the clamping assembly 40 and the surface of the grinding wheel 13 is a central cutting point C. The horizontal projection of the central cutting point C onto a perpendicular surface at the vertical wall of the base member 21 is a horizontal axial point C', and the assembling portion 222 has a center point that is shifted downward from the horizontal axial point C' to form an eccentric axis point A with respect to the assembling portion 213 of the base member 21. In operation, when the rotating seat 22 is rotated within base member 21 to drive the clamping assembly 40 and the drill bit 99, the tip of the drill bit 99 will axially rotate for approximately 90 degrees about the central cutting point C of the drill bit 99 while remaining in contact with the surface of the grinding wheel 13. The center point of the assembling portion 222 will rotate from eccentric axis point A to a grinding deviation point B to produce cutting and grinding effects on the surface of the tip of the drill bit 99 about the central cutting point C. In the present invention, the rotating seat assembling portion 213 of the base member 21 further includes a slanted socket that provides a horizontal offset axis point A' for aligning the first shifting axis CA' of the base member 21 of the rotating seat 22 at a shifting angle from −10 to 10 degrees with respect to the reference axis CC', and aligning the second shifting axis CA of assembling portion 222 of the rotating seat 22 at 0 to −5 degrees with respect to the reference axis CC', such that the rotating seat 22 rotates on the base member 21 to produce cutting and grinding effects on the surface of the tip of the drill bit 99 about the central cutting point C, the clamping tool 40 and the drill bit 99 rotate about the first shifting axis CA', and the second shifting axis CA by using the reference axis CC' as the center, and thus the periphery and the tip of the drill bit 99 are cut and ground to form different curvatures and cambered surfaces by the two different shifting axes moving at the same time.

Figures 2, 8:
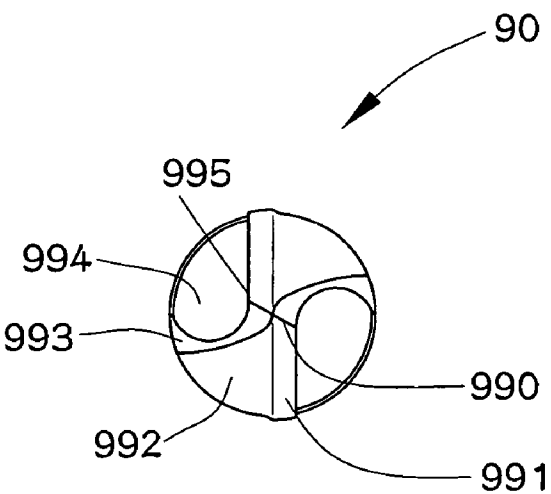
Figures 1, 8:
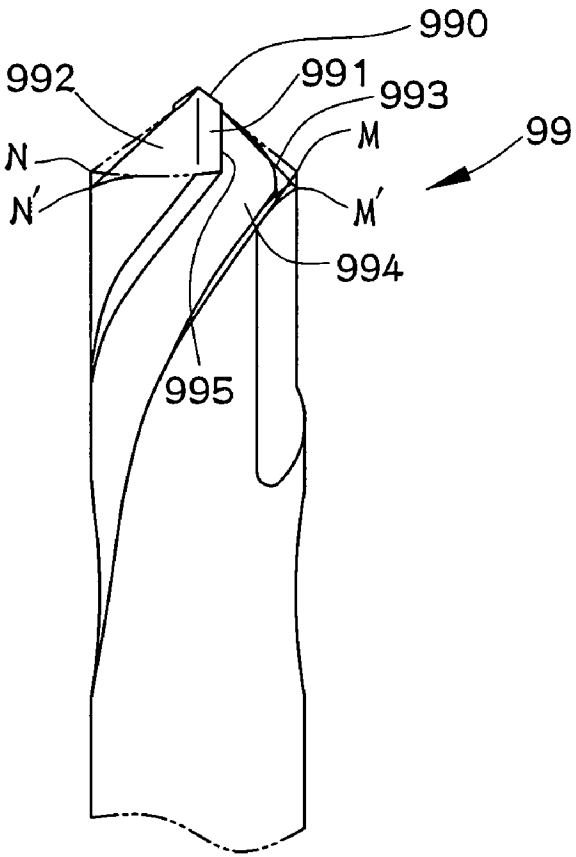
Figure 9:
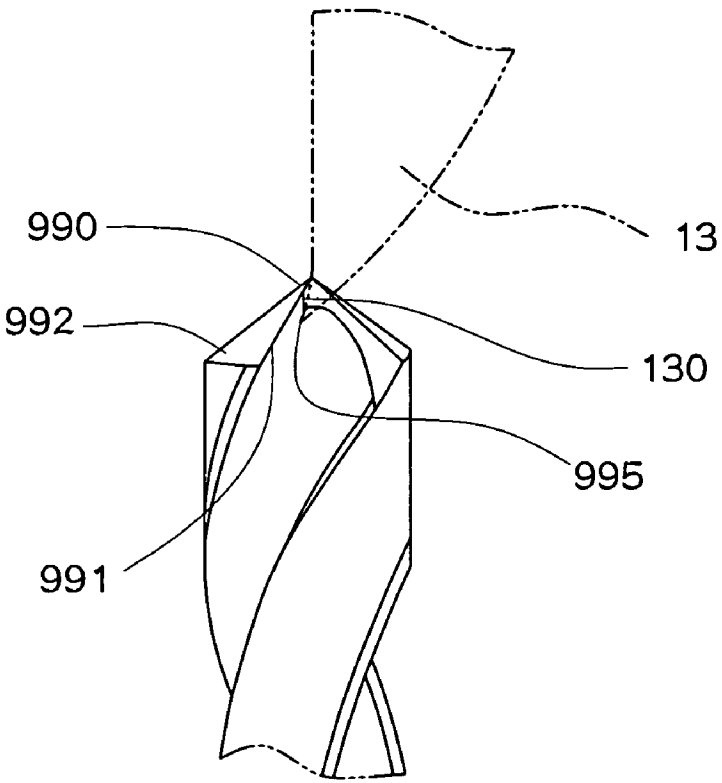
FIG. 9 is a side view of the drill bit of FIG. 8-1.

Referring to FIGS. 7-3, 8-1, 8-2 and 9, the center of the tip end of the drill bit 99 is an apex 990, the drill bit forms two straight blade edges 991 depending on the required quantity of blade edges, and the blade edge 991 is extended towards a curved cutting extension 992 along the direction of the left spin or right spin drill bits, and the end of the cutting extension 992 forms a steep-angled bevel 993, and a debris removing chute 994 is disposed behind a bevel 993, and a slanting cutting blade edge 995 is formed at the bevel 993 extended to the apex 990, wherein the blade edges 991 and cutting extensions 992 are formed when the clamping tool 40 with drill bit 99 is inserted in the first grinding seat 20, and the bevel 993 and slanting cutting blade edge 995 are formed when the clamping tool 40 with drill bit 99 is inserted in the second grinding seat 30. As compared with the first slanting curvature MN of cutting extension 992 formed only by grinding with the second shifting axis CA, the present invention can also form a second slanting curvature M'N' cutting extension 992 by using the two shifting axes simultaneously. During the rotation of the clamping tool 40 with drill bit 99, the apex 990 and the cutting center C of the drill bit 99 are fixed, only part of the cutting extension 992 is unequally ground at a high speed, as shown in FIG. 8-1. In the preferred embodiment as shown in the Figures, the amount of shifting of the first shifting axis CA' relative to the reference axis CC' is within 0-10 degrees. In other words, when the first shifting axis CA' shifts, the cutting extension 992 leans towards the surface of the grinding wheel 13 quickly form a larger slanting curvature of the cutting extension 992, so that the curvature of the second cutting extension curve M'N' is relatively large, and the support force of the blade edges 991 is decreased, and the strength of the blade edges 991 is decreased. It is then suitable for grinding the work piece with a relatively low hardness. If the surface of a softer work piece is milled and the angle of the first shifting axis CA' with respect to the reference axis CC' is negative, the grinding quantity of the cutting extension 992 then will be decreased, and thus the second slanting curvature M'N' of cutting extension 992 becomes flat, and the supporting force of the blade edge 991 becomes larger, and thus the drill bit 99 can stand a larger miller force, which is suitable for grinding the surface of a harder drill bit 99.

Figure 10:
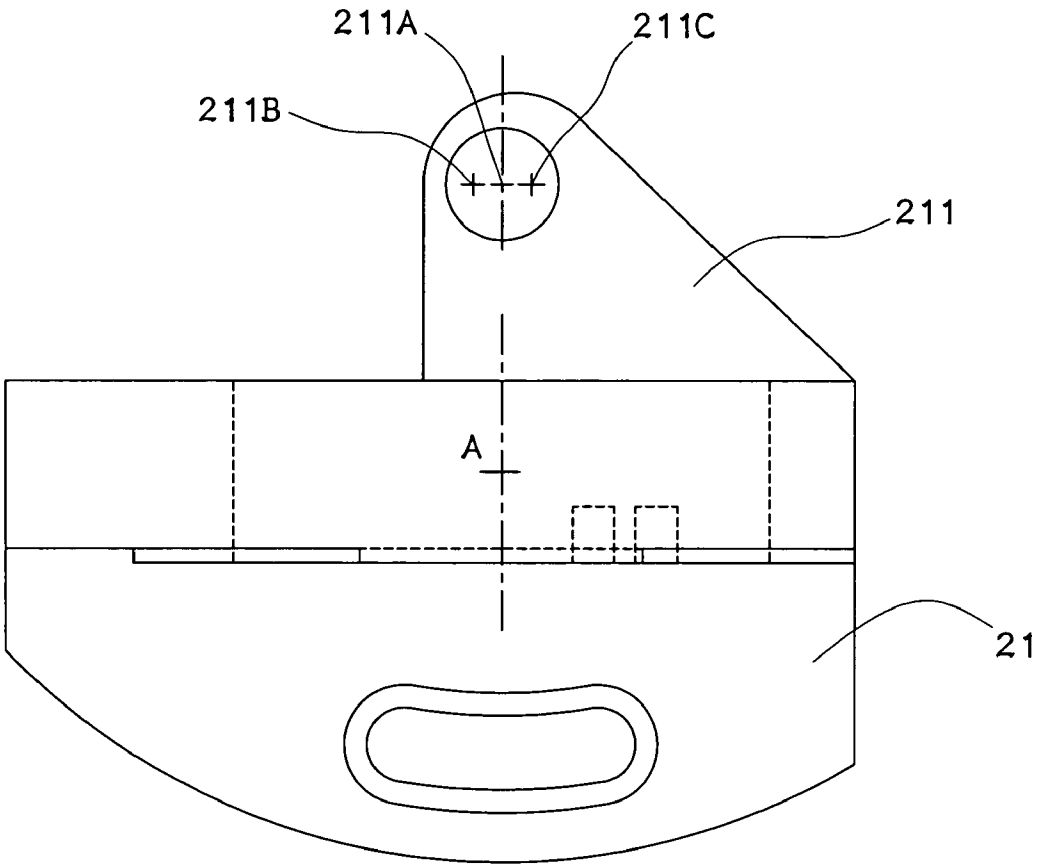
FIG. 10 shows the pivoting portion and the deflection point of the first grinding seat of the present invention.
Figure 12:
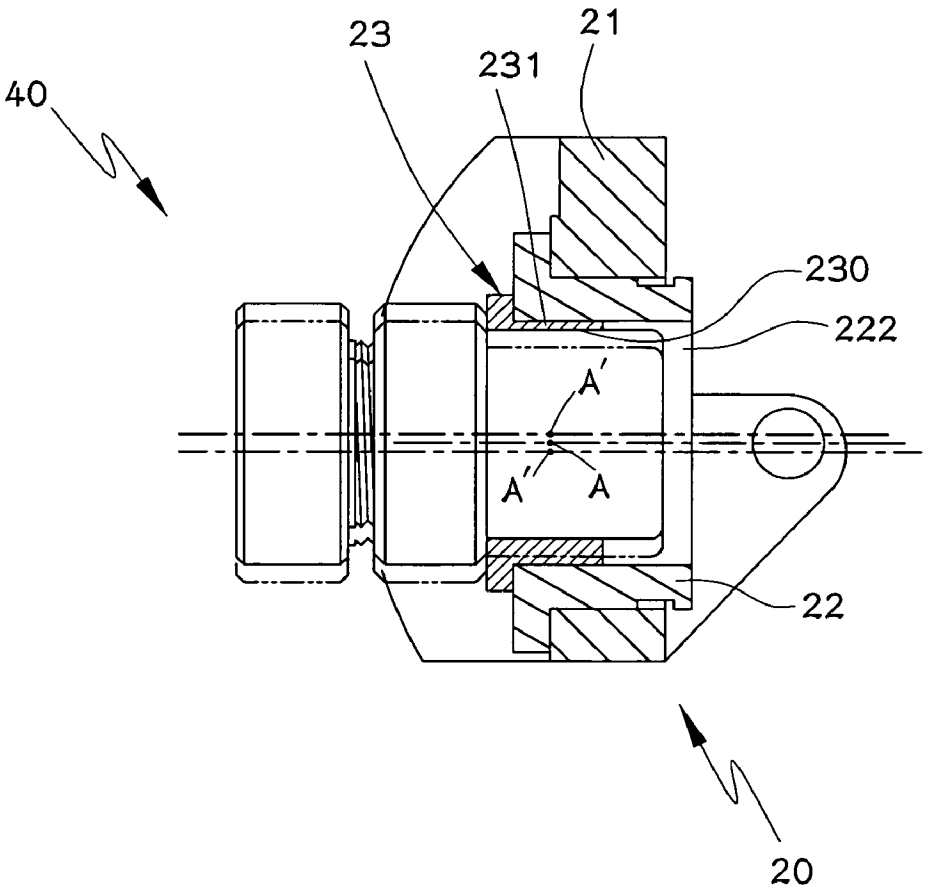
FIG. 12 is a cross sectional view showing the first grinding seat of the present invention.

As shown in FIGS. 10-12, the pivot portion 211 of the base member 21 is inserted on the pivoting point 211A of the base 100 and may perform a compensating displacement for the shifting axis point A' to a complementary displacement point 211B or 211C. The assembling portion 213 of the base member 21 maintains perpendicular to the vertical portion of the base member 21 and, not in the form of a slanting socket so as to achieve the aforementioned effect of enhancing the cutting function. With the same design, another deviating member 23 is installed between the base member 21 and the rotating seat 22 (not shown) or between the rotating seat 22 and the clamping tool 40, as shown in FIG. 11, to achieve the same effect. For example, the clamping tool 40 is installed into receiving portion 230 of the deviating member 23, where the exterior of deviating member 23 forms a sheathing portion 231 having a flange with a large diameter at an end and a small diameter at the other end, wherein the socket position of the sheathing portion 231 is concentric with the center of the rotating seat 22, and the receiving portion 230 can be in the form of a slanting socket that has a center point that is shifted from the horizontal axial point C' to form an eccentric axis point A with respect to the receiving portion 230 of the deviating member 23 in a similar manner as with a slanted socket in the assembling portion 213 of the previous embodiment, so as to change the position of the center for passing through the drill bit 99 and achieve the multi-axis cutting and grinding effect. The receiving portion 230 can be formed at a bias center position of the sheathing portion 231, as shown in FIG. 12, to provide for the cutting and grinding of different lengths of the blade edges 991 and cutting extensions 992 of the drill bit 99.

Another characteristic of the present invention resides on that a back grinding side 130 of the grinding wheel 13 that is in the form of an inwardly slanting acute angle substantially maintaining an angle from 0 degree to 5 degrees with a parallel line on the backside of the grinding wheel 13, so that when grinding wheel 13 carries out a cutting process on the drill bit 99 when clamping tool 40 with drill bit 99 is inserted in the second grinding seat 30, blade edge 991 is formed in a non-vertical form and has an inner slant angle of 0-5 degrees in the vertical direction.

While we have shown and described various embodiments in accordance with the present invention, it is clear to those skilled in the art that further embodiments may be made without departing from the scope of the present invention.

What is claimed is:

1. A double-grinding-wheel type drill bit grinding device with a single driving shaft comprising:

a motive power source disposed on a base, two grinding wheels being disposed at opposite ends of the single driving shaft extending out of the motive power source;

a pair of sets of first and second grinding seats, each set of first and second grinding seats being disposed adjacent a respective grinding wheel at both ends of the driving shaft, each set of seats including a clamping assembly for clamping a drill bit to support the drill bit upon sequential insertion into one set of the first and second grinding seats, and each set of seats including a positioning device being disposed on a front surface of the base for providing alignment of the drill bit within the clamping assembly prior to the insertion of the drill bit into one set of the first and second grinding seats.

2. The double-grinding-wheel type drill bit grinding device with a single driving shaft as claimed in claim 1, wherein each first grinding seat includes a base member, a slide slot is defined in a bottom plate of the base member, at the other end of the bottom plate of the base member is formed a pivoting portion to be fixed on the base, so that the base member is rotatable around the pivoting portion, an eccentric rotating seat is mounted in a socket in a vertical wall of the base member, and positioning pins are formed on a vertical surface of the rotating seat for cooperating with the clamping assembly, the rotating seat is further provided with a limit portion located opposite the vertical wall of the base member, and opposite limit pins are correspondingly formed on the base member.

3. The double-grinding-wheel type drill bit grinding device with a single driving shaft as claimed in claim 1, wherein the pivoting portion of the base member of each first grinding seat is inserted on a pivoting point of the base to perform compensating displacement around a deflection axis point A' and can move the deflection point while the assembling portion of the base member is kept in the vertical portion of the base member.

4. The double-grinding-wheel type drill bit grinding device with a single driving shaft as claimed in claim 1, wherein a deflection member is disposed between the rotating seat and the clamping assembly.

5. The double-grinding-wheel type drill bit grinding device with a single driving shaft as claimed in claim 4, wherein the deflection member is defined with an inner space for insertion of the clamping assembly, the defection member has a large-diameter flange formed at one end thereof and a small-diameter mounting portion formed at the other end thereof, the mounting portion is concentric with the center of the rotating seat, the inner space is shaped in the form of a slant socket.

6. The double-grinding-wheel type drill bit grinding device with a single driving shaft as claimed in claim 5, wherein the inner space of the deflection member is located eccentrically to the center of the mounting portion according to different lengths of the cutting edges, so that the grinding wheel can grind the drill bit with two cutting edges of different lengths.

7. The double-grinding-wheel type drill bit grinding device with a single driving shaft as claimed in claim 1, wherein the motive power source is a pneumatic motor, with one end of the pneumatic motor being an air-intake end, and the other end being an air-discharge end.

8. The double-grinding-wheel type drill bit grinding device with a single driving shaft and as claimed in claim 7, wherein vacuum passage is defined in the base and located at the position of the pneumatic motor, wherein open ends of the vacuum passage are located at the two grinding wheels.

9. The double-grinding-wheel type drill bit grinding device with a single driving shaft and as claimed in claim 1, wherein a large storing member in the form of a drawer is disposed in an inner space at the bottom of the base, and in the storing member is disposed a holding rack.

10. The double-grinding-wheel type drill bit grinding device with a single driving shaft as claimed in claim 1, wherein a backside grinding surface of the grinding wheel is shaped in the form of an inward-slanting sharp angle and is maintained at 0-5 degrees with respect to a plane parallel to the backside surface.

11. The double-grinding-wheel type drill bit grinding device with a single driving shaft as claimed in claim 1, wherein a deflection member is disposed between the base member and the rotating seat.

12. A double-grinding-wheel type drill bit grinding device with a single driving shaft comprising: a motive power source disposed on a base, two grinding wheels being disposed at opposite ends of the single driving shaft extending out of the motive power source, a pair of sets of first and second grinding seats, each set of first and second grinding seats being disposed adjacent a respective grinding wheel at both ends of the driving shaft, each set of seats including a clamping assembly for clamping a drill bit to support the drill bit upon sequential insertion into one set of the first and second grinding seats, and each set of seats including a positioning device being disposed on a front surface of the base for providing alignment of the drill bit within the clamping assembly prior to the insertion of the drill bit into one set of the first and second grinding seats;

each first grinding seat includes a base member and an eccentric rotating seat that is mounted in a first assembling portion in the form of a socket in a vertical wall of the base member, the rotating seat is also formed with a second assembling portion in the form of a socket for mounting the clamping assembly, wherein a contact point along an axis of the drill bit at the center of the clamping assembly with respect to the surface of the grinding wheel is a central cutting point C, a point of the central cutting point C projected onto a vertical surface of the base member is a horizontal-axis point C', a center of the second assembling portion of the rotating seat deflects downward to form an eccentric axis point A, the first assembling portion of the base member is in the form of a slant socket and is provided with a horizontal deflection axis point A', a first deflection axis CA' of the rotating seat on the base member is deflectable within a defection angle of −10 to 10 degrees relative to a reference axis CC', and a second deflection axis CA of the second assembling portion of the rotating seat is also deflectable at an vertical deflection angle 0-5 degrees with respect to the reference axis CC'.

13. The double-grinding-wheel type drill bit grinding device with a single driving shaft as claimed in claim 12, wherein a center of a sharp end of the drill bit is an apex, the drill bit is provided with two straight blade edges that extend in opposite directions from the apex, respectively to form an arc-shaped cutting extension, at an end of the cutting extension is formed a bevel, and a debris removing chute is formed adjacent to the bevel, the bevel extends to the apex to form a cutting blade edge along the blade edge, wherein the first grinding seat is used to grind the blade edges and the cutting extensions, and the second grinding seat serves to grind the bevel and the cutting blade edge, when the rotating seat of each first grinding seat rotates on the base member to drive the clamping assembly and the drill bit, the center of the sharp end of the drill bit is positioned at the central cutting point C, and the drill bit rotates eccentrically about a combined deflection axes of the first and second assembling portions when rotating on the rotary seat of the base member during grinding operation, the clamping assembly and the drill bit is allowed to deflect a distance along the first and second deflection axes CA' and CA and about the reference axis CC', so that the peripheral surfaces of the sharp end of the drill bit can be processed simultaneously by the two deflection axes to produce different curvatures and arc-shaped surfaces at the sharp end of the drill bit, the rotation of the drill bit about the combined deflection axes of the first and second assembling portions a second arc-shaped side line M'N' is formed, during the rotation of the drill bit, the apex and the central cutting point C of the drill bit are fixed, only part of the cutting extension is unequally ground at a high speed, the amount of deflection of the first deflection axis CA' relative to the reference axis CC' is within 0-10 degrees, whereas, when drill bit deflects, the cutting extension will move toward the surface of the grinding wheel to increase the grinding depth, so that the curvature of the second arc-shaped side line M'N' is relatively large.

14. The double-grinding-wheel type drill bit grinding device with a single driving shaft as claimed in claim 13, when the first deflection axis CA' is located at a negative angle with respect to the reference axis CC', the grinding amount of the cutting extension reduces, a second arc-shaped side line M'N' is relatively flat, a supporting force of the blade edges is relatively large, and the strength of the drill bit increases and is suitable for grinding or cutting a work piece with a relatively high hardness.

15. A double-grinding-wheel type drill bit grinding device with a single driving shaft comprising: a motive power source disposed on a base, two grinding wheels being disposed at opposite ends of the single driving shaft extending out of the motive power source, a pair of sets of first and second grinding seats, each set of first and second grinding seats being disposed adjacent a respective grinding wheel at both ends of the driving shaft, each set of seats including a clamping assembly for clamping a drill bit to support the drill bit upon sequential insertion into one set of the first and second grinding seats, and each set of seats including a positioning device being disposed on a front surface of the base for providing alignment of the drill bit within the clamping assembly prior to the insertion of the drill bit into one set of the first and second grinding seats;

the second grinding unit includes a base member to be positioned on a supporting member, one end of the base member is pivotally connected to the supporting member by a bolt, and the other end of the base member is provided with a bolt to be inserted and positioned in the supporting member, a central shaft of a cam-controlling element is provided with an abutting member in a form of a cam.

16. The double-grinding-wheel type drill bit grinding device with a single driving shaft as claimed in claim 15, wherein the supporting member extends vertically from a bottom of the base member.

* * * * *